United States Patent [19]

Holekamp

[11] Patent Number: 4,597,201

[45] Date of Patent: Jul. 1, 1986

[54] ANGLED BOOM DREDGE SYSTEM AND CUTTERHEAD THEREFOR

[76] Inventor: Malcolm L. Holekamp, 344 Gray Ave., St. Louis, Mo. 63119

[21] Appl. No.: 721,049

[22] Filed: Apr. 8, 1985

[51] Int. Cl.[4] ..... E02F 3/90

[52] U.S. Cl. ..... 37/64

[58] Field of Search ..... 37/64–67; 406/135

[56] References Cited

U.S. PATENT DOCUMENTS

| | | | |
|---|---|---|---|
| 805,965 | 11/1905 | Jones | 37/67 |
| 1,246,990 | 11/1917 | Ohlhausen | 37/67 |
| 1,619,850 | 3/1927 | Casey | 37/67 |
| 2,933,837 | 4/1960 | Nelson | 37/65 |
| 3,253,357 | 5/1966 | Allard | 37/65 |
| 3,495,409 | 2/1970 | Riedemann | 37/64 X |
| 4,123,858 | 11/1978 | Batchelder | 37/64 X |
| 4,211,020 | 7/1980 | Holekamp | 37/65 |

FOREIGN PATENT DOCUMENTS

| | | | |
|---|---|---|---|
| 2608665 | 9/1977 | Fed. Rep. of Germany | 37/64 |
| 2923518 | 12/1980 | Fed. Rep. of Germany | 37/64 |
| 2129 | 1/1980 | Japan | 37/64 |
| 7611570 | 4/1978 | Netherlands | 37/67 |

*Primary Examiner*—Clifford D. Crowder

*Attorney, Agent, or Firm*—Polster, Polster and Lucchesi

[57] ABSTRACT

A dredge with an elongated boom mounted to extend at an angle from the vertical has at a lower free end of the boom a pump inlet and disc-cutters mounted on the boom. The disc-cutters are rotated on axes of rotation lying at an acute angle to a continuation of the long axis of the boom beyond its free end whereby the disc cutters are tilted toward the inlet mouth at their near sides. The axes of rotation of the discs are also at an angle from the perpendicular with respect to the surface of liquid on which the dredge floats greater than that of the boom so that the axes of rotation of the discs are more nearly perpendicular to the vertical than is the axis of the boom.

1 Claim, 4 Drawing Figures

ANGLED BOOM DREDGE SYSTEM AND CUTTERHEAD THEREFOR

BACKGROUND OF THE INVENTION

The types of pumps and disc-cutters to which the present application is directed are described in detail in my U.S. Pat. No. 4,170,079. In the dredge there described, a vertical boom is provided, and cutter-discs are mounted on axes of rotation parallel to the long axis of the boom, so that the plane of the discs is substantially parallel with the surface of the liquid on which the dredge is floating, and perpendicular to the long axis of the boom. In this configuration, the discs can be rotated in either direction, provided the cutters are symmetrical. Such disc-cutters were not considered adaptable to booms that were pivoted for a rather shallow angle with respect to the surface of liquid on which the dredge floated.

It has been found that by mounting the disc-cutters with certain orientation with respect both to the long axis of the boom and the surface of the liquid on which the dredge is floating, excellent results can be obtained with the disc-cutters oriented in a generally vertical direction as distinguished from the horizontal direction of the prior art.

One of the objects of this invention is to provide a dredge of the type in which a boom extends at an angle from the vertical with an improved cutter arrangement that is simple to manufacture and use and admits of the use of the same type of disc-cutter as is described in my U.S. Pat. No. 4,170,079.

Other objects will become apparent to those skilled in the art in the light of the following description and accompanying drawing.

SUMMARY OF THE INVENTION

In accordance with this invention, generally stated, a dredge, with floatation means, has an elongated boom mounted to extend at an angle from the vertical from the floatation means. The boom has a lower free end and a lower surface. A pump, preferably of the underwater type, has an inlet adjacent the free end of the boom and oriented generally in the line of the long axis of the boom. Disc-cutter means are mounted on the boom at its free end. The disc-cutter means includes a disc on the periphery on which cutters are mounted and means for rotating the disc. The disc is mounted on an axis of rotation lying at an acute angle to a continuation of the long axis of the boom beyond the free end thereof, whereby the disc is tilted toward the inlet mouth of the pump at its near side and also at an angle from the perpendicular with respect to the surface of liquid on which the dredge floats greater than the angle of the boom, so that the disc is oriented more nearly vertically than the boom axis. The disc cutter is so mounted that the disc extends below the lower surface of the boom, and the disc is rotated in the direction in which the cutters along the lower reach of the disc move toward the inlet mouth. In the preferred embodiment, two disc-cutters are mounted, one on either side of the pump inlet.

In the preferred embodiment, the pump and a gearbox are mounted at the free end of the boom, and are driven by a prime mover mounted on the boom above a point at which the boom is pivoted to the floatation means. This provides a relatively inexpensive and efficient arrangement.

DESCRIPTION OF THE PREFERRED EMBODIMENT

Figure 1:
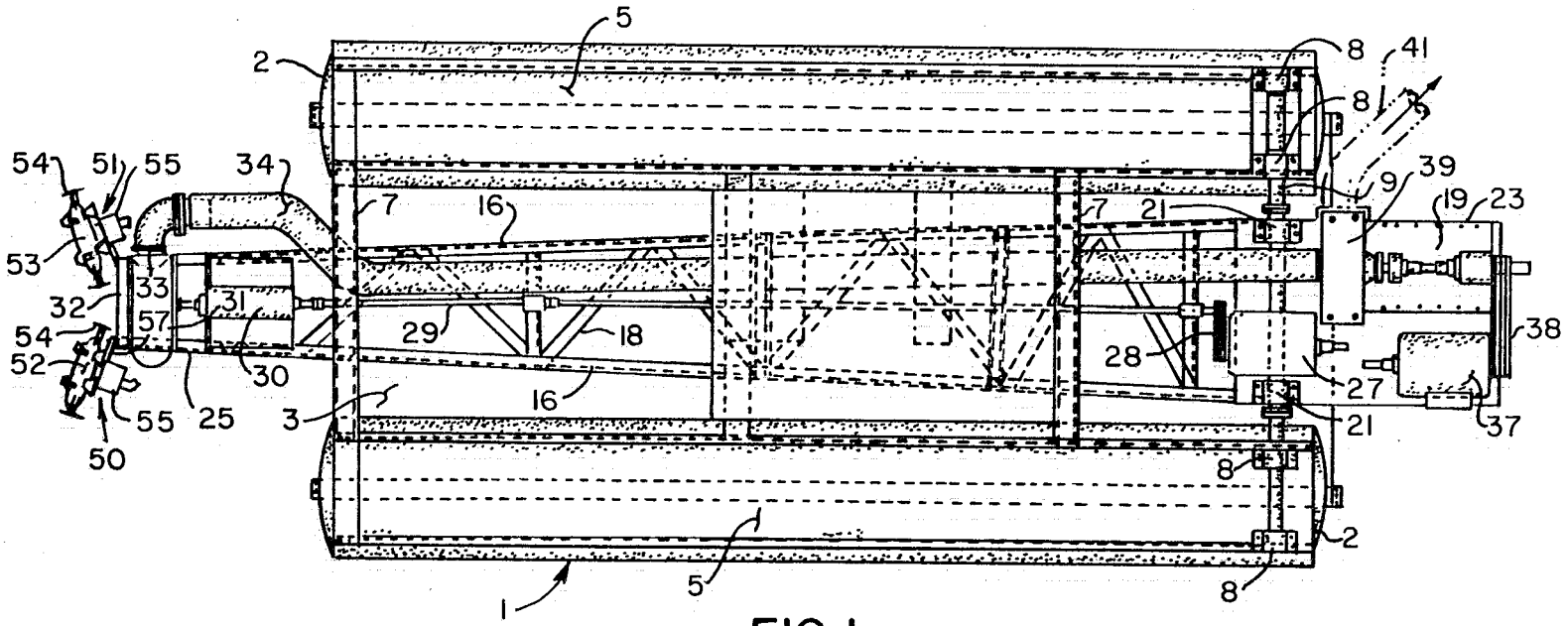
FIG. 1 is a top plan view of a dredge embodying one illustrative embodiment of this invention.

Referring now to the drawing for one illustrative embodiment of this invention, reference numeral 1 indicates a complete dredge made up of floatation means in the form of tanks 2, parallel with one another and spaced so as to define between them a well 3. The tanks are protected by gunnel plates 4, both outboard and inboard of the tanks, deck plates 5, and in this illustrative embodiment, skids 6 along the bottom edges of the gunnel plates. The two floatation devices are bridged, spaced and connected by cross beams 7 across the tops of the tanks.

Near the stern of the dredge, pillow blocks 8 mounted on the deck plates, are aligned to receive a boom pivot shaft 9. The usual superstructure is provided, which in this case includes a winch with a cable reeved through an upper pulley 13 suspended from a bow stanchion 12 and through a boom pulley 14 attached to the upper frame work of a boom 15 near the lower end of the boom.

Figures 2, 4:
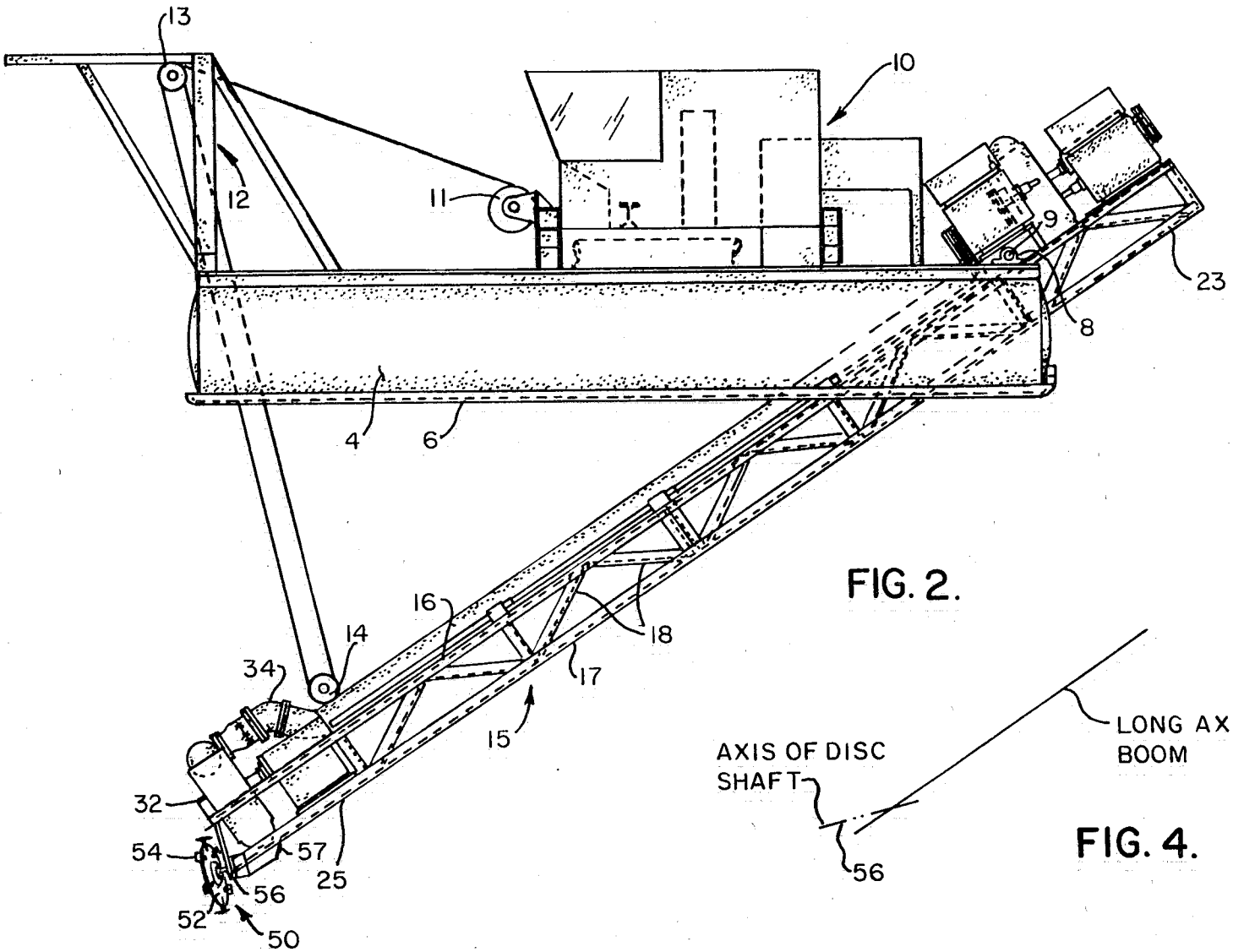
FIG. 2 is a view in side elevation.
FIG. 4 is a diagrammatic view in side elevation showing angulation of axes of rotation of disc elements in a plane perpendicular to the plane in which the disc elements and boom axis are shown in FIG. 3.

The boom 15 is made up of upper rails 16, lower rails 17 and the usual vertical and horizontal cross bracing 18. A platform 19 is secured to the after end of the upper surface of the boom. Boom bearing blocks 21 are mounted on the platform 19, aligned with the pillow blocks 8. The boom shaft 9 is journaled in the bearing blocks 21, to permit the boom to be rotated about the shaft 9, between a position at which the boom is substantially within the well 3 and a position at which a lower end 25 of the boom is substantially below the surface of the liquid on which the dredge floats, as illustrated in FIG. 2. As can be seen from FIG. 2, when the lower free end of the boom 25 is lowered, an upper end section 23 of the boom is raised above the level of the deck 5.

A main pump motor 27 is mounted on the platform 19 in the vicinity of the shaft 9. The main pump motor is connected by belts 28 to a shaft 29, which in turn is connected to a gearbox 30 from which an output shaft is operatively connected to the impeller of a submersible pump 31. The submersible pump 31 has an inlet mouth 32 and an outlet side 33 connected to deliver spoil to a spoil conduit 34. The spoil conduit 34 is connected to an inlet side of a booster pump 39, an outlet side of which is connected to a flexible spoil pipe 41. The booster pump 39 is driven by a booster pump motor 37 by means of belts 38. The booster pump and booster pump motor are mounted on the platform 19. The gearbox 30 and submersible pump 31 are mounted on the boom at its free end 25.

Mounted on and extending forward of the lower end 25 of the boom 15 is a disc-cutter assembly 50 on one side of the inlet mouth 32 and a disc-cutter assembly 51 on the other side of the inlet mouth 32 as viewed in plan FIG. 1. The disc-cutter assembly 50 has a disc 52. The disc-cutter assembly 51 has a disc 53. Both of the discs 52 and 53 are equipped with cutters 54. Discs and cutters can be of the type shown and described in U.S. Pat. No. 4,170,079. Each of the disc-cutter assemblies includes a hydraulic motor 55, with a shaft 56 by which the disc is rotated. Each of the disc cutter assemblies is secured to the boom by means of a disc cutter assembly bracket 57.

Figure 3:
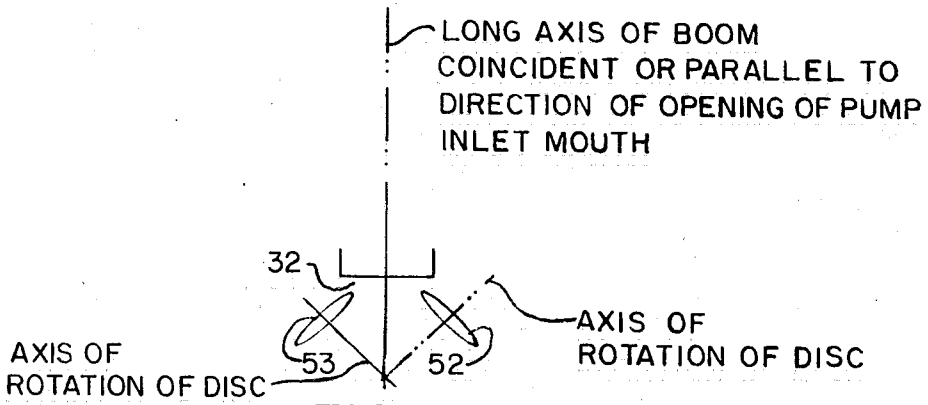
FIG. 3 is a diagrammatic top plan view showing angulation of axes of rotation of disc elements with respect to a boom axis.

As can be seen by the figures, the shaft 56, i.e. the axis of rotation of the discs 52 and 53, is set at angles to the long axis of the boom in two, perpendicular planes, as shown particularly in FIGS. 3 and 4, one of which is coincident with or parallel to the plane of the lower surface of the boom defined by the lower edges of the lower rails 17, as shown particularly in FIG. 2.

It has been found that, contrary to conventional experience, the disc-cutters 52 and 53 will operate efficiently to cut out and stir up spoil such as sediment and gravel, and direct it to the inlet 32 of the pump, even when operating with the discs in a substantially vertical position relative to the surface of the liquid on which the dredge is floating, i.e. when the axis of rotation of the discs is substantially parallel to the surface of the liquid. As can be appreciated, the actual angulation of the discs with respect to the surface will be determined by the angle of the boom with respect to the surface. However, the angle to which the boom is expected to be lowered can be determined, and the angulation of the discs can be adjusted in advance of their use to give whatever angulation with respect to the bottom is desired.

Numerous variations will occur to those skilled in the art in the light of the foregoing disclosure. Merely by way of example, although the stern pivoting of the boom as shown offers a number of advantages, the boom could be otherwise mounted on the dredge to tend at an angle from the horizontal. It has been found that using the angulation of the discs toward the inlet mouth produces unexpectedly good results, but the combination of the angulations provides optimum results. The use of a shaft driven gearbox permits the positioning of electric motors on the boom as shown in FIGS. 1 and 2, which has advantages of economy, but the pump 31 can also be hydraulically driven if desired, hydraulic drives being provided for the discs in the embodiment shown in any event. Other means for driving the discs can be used, provided that the angulation is maintained. The main dredge pump is preferably submersed and its inlet side immediately exposed to the spoil cut by the disc-cutters, but a suction tube from a pump positioned above the free end of the boom, with an inlet mouth in the same position as the inlet mouth 32 can be employed. The term pump means embraces both arrangements. The mouth must tend forwardly with respect to the boom, but, although the embodiment shown, in which the mouth is oriented in the plane of the long axis of the boom, is preferred, the mouth can tend somewhat downwardly, for example. These are merely illustrative.

I claim:

1. A dredge comprising floatation means spaced to define between them a longitudinal well through the length of said dredge fore and aft; an elongated boom tending along said well and having an outer, free end projecting forward of the bow of said dredge; pivot means near the end of the boom opposite the free end for pivotally mounting said boom on said floatation means at the stern of said dredge; means for moving said boom free end about said pivot; a pump mounted on said boom adjacent the free end thereof, said pump having an inlet mouth directed generally in the line of the long axis of said boom; disc-cutter means supported by said boom, said disc-cutter means including a pair of discs, one on either side of the said inlet mouth, and cutters mounted on the peripheries of said discs and extending radially outwardly therefrom, and means for rotating said discs, said discs being mounted on axes of rotation lying at an acute angle to a continuation of the long axis of the boom beyond the free end thereof, whereby the discs are tilted toward the inlet mount of the pump means at their near sides, and the axes of rotation of said discs are also at an upward angle with respect to the plane of the lower surface of said boom, whereby the axes of rotation of the discs are more nearly perpendicular to the vertical than is the axis of the boom, said discs being so mounted that they extend below the lower surface of said boom, the discs being rotated in the directions in which the cutters along the lower reach of the disc move toward said inlet mouth.

* * * * *